US010174666B2

(12) United States Patent
Richter et al.

(10) Patent No.: US 10,174,666 B2
(45) Date of Patent: Jan. 8, 2019

(54) METHOD FOR OPERATING A COOLING SYSTEM OF AN INTERNAL COMBUSTION ENGINE AND PROTECTION SYSTEM IN A COOLING SYSTEM

(71) Applicant: Bayerische Motoren Werke Aktiengesellschaft, Munich (DE)

(72) Inventors: Rainer Richter, Munich (DE); Georg Chekaiban, Wolnzach (DE); Holger Brandt, Munich (DE); Andreas Klemm, Munich (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 0 days.

(21) Appl. No.: 15/435,337

(22) Filed: Feb. 17, 2017

(65) Prior Publication Data

US 2017/0159548 A1 Jun. 8, 2017

Related U.S. Application Data

(63) Continuation of application No. PCT/EP2015/069070, filed on Aug. 19, 2015.

(30) Foreign Application Priority Data

Aug. 21, 2014 (DE) ..... 10 2014 216 658

(51) Int. Cl.
*F01P 11/14* (2006.01)
*F01P 7/14* (2006.01)
*F02D 31/00* (2006.01)

(52) U.S. Cl.
CPC ..... *F01P 11/14* (2013.01); *F01P 7/14* (2013.01); *F02D 31/001* (2013.01);
(Continued)

(58) Field of Classification Search
CPC ..... F01P 2007/146; F01P 2060/06; F01P 2031/00; F01P 11/14; F01P 2031/20;
(Continued)

(56) References Cited

U.S. PATENT DOCUMENTS 5,070,832 A 12/1991 Hapka et al.
5,979,373 A 11/1999 Sano
(Continued)

FOREIGN PATENT DOCUMENTS

CN 1239179 A 12/1999
DE 692 02 189 T2 9/1995
(Continued)

OTHER PUBLICATIONS

International Search Report (PCT/ISA/210) issued in PCT Application No. PCT/EP2015/069070 dated Oct. 30, 2015 with English translation (Six (6) pages).
(Continued)

*Primary Examiner* — Long T Tran
(74) *Attorney, Agent, or Firm* — Crowell & Moring LLP

(57) ABSTRACT

A method is provided for operating a cooling system of an internal combustion engine, which cooling system has a controllable rotary slide valve with at least one switched inlet or outlet. The movement of the rotary slide valve into a plurality of switching positions, which each correspond with a cooling system state, is monitored. In accordance with an improper functional state of the rotary slide valve and a current switching position of the rotary slide valve, an operating state of the internal combustion engine is changed to an emergency operation state. A protection system in the cooling system carries out the method and includes a thermal management system, which receives and processes coolant temperatures, and a control unit of a controllable rotary slide valve having a position detector, which can
(Continued)

detect a current switching position of the switchable rotary slide valve, wherein the thermal management system is connected to the control unit of the rotary slide valve.

18 Claims, 2 Drawing Sheets

(52) U.S. Cl.
CPC ..... *F01P 2007/146* (2013.01); *F01P 2025/08* (2013.01); *F01P 2031/00* (2013.01); *F01P 2031/34* (2013.01); *F02D 2200/021* (2013.01)

(58) Field of Classification Search
CPC ..... F02D 2009/0277; F02D 41/221; F16K 31/046; F01L 7/10
See application file for complete search history.

(56) References Cited

U.S. PATENT DOCUMENTS

| | | | | |
|---|---|---|---|---|
| 8,671,982 | B2 * | 3/2014 | Stoermer | F16K 11/0856 123/41.1 |
| 9,115,634 | B2 * | 8/2015 | Triebe | F01P 7/161 |
| 2002/0121618 | A1 | 9/2002 | Williges | |
| 2003/0172882 | A1 | 9/2003 | Nakano | |
| 2004/0094102 | A1 | 5/2004 | Bernarding et al. | |
| 2005/0049819 | A1 | 3/2005 | Longnecker et al. | |
| 2012/0137992 | A1 | 6/2012 | Kinomuka et al. | |
| 2014/0083376 | A1 * | 3/2014 | Bohm | F01P 7/165 123/41.1 |
| 2014/0230758 | A9 * | 8/2014 | Bohm | F01P 7/165 123/41.1 |

FOREIGN PATENT DOCUMENTS

| | | | |
|---|---|---|---|
| DE | 199 60 190 | A1 | 7/2001 |
| DE | 102 43 778 | A1 | 3/2004 |
| DE | 103 33 963 | A1 | 2/2005 |
| DE | 10 2004 038 810 | A1 | 3/2005 |
| DE | 10 2011 081 183 | A1 | 2/2013 |
| DE | 20 2014 100 189 | U1 | 2/2014 |
| EP | 0 978 641 | A1 | 2/2000 |
| EP | 2 587 017 | A1 | 5/2013 |

OTHER PUBLICATIONS

German-language Written Opinion (PCT/ISA/237) issued in PCT Application No. PCT/EP2015/069070 dated Oct. 30, 2015 (Five (5) pages).

German Search Report issued in counterpart German Application No. 10 2014 216 658.6 dated Apr. 21, 2015 with partial English translation (12 pages).

English translation of Chinese-language Office Action issued in counterpart Chinese Application No. 201580043514.8 dated Jun. 21, 2018 (six (6) pages).

* cited by examiner

METHOD FOR OPERATING A COOLING SYSTEM OF AN INTERNAL COMBUSTION ENGINE AND PROTECTION SYSTEM IN A COOLING SYSTEM

CROSS REFERENCE TO RELATED APPLICATIONS

This application is a continuation of PCT International Application No. PCT/EP2015/069070, filed Aug. 19, 2015, which claims priority under 35 U.S.C. § 119 from German Patent Application No. 10 2014 216 658.6, filed Aug. 21, 2014, the entire disclosures of which are herein expressly incorporated by reference.

BACKGROUND AND SUMMARY OF THE INVENTION

The invention relates to a method for operating a cooling system of an internal combustion engine, and to a protection system in a cooling system.

The use of a controllable rotary slide valve with switched inlets permits considerably more flexible and faster regulation of the cooling system in relation to the use of conventional wax actuators.

It is sought, in a cooling system of an internal combustion engine, to realize the most dynamic possible control of the cooling system states, and in particular to be able to set the target temperature in the cooling system as accurately as possible, in order to reduce the emissions of the internal combustion engine. The potential that lies in the switching dynamics should in this case be fully exploited without reducing the functional reliability of the internal combustion engine.

It is an object of the invention to optimize the operation of a cooling system of an internal combustion engine.

This is achieved by way of a method for operating a cooling system of an internal combustion engine, in which a controllable rotary slide valve having at least one switched inlet or outlet is provided. The movement of the rotary slide valve into multiple switching positions which correspond to, in each case, one cooling system state is monitored. In a manner dependent on an improper functional state of the rotary slide valve and a present switching position of the rotary slide valve, an operating state of the internal combustion engine is changed to an emergency operation state.

Owing to the greater possible dynamics, the possibility of a prompt reaction in the event of faults during operation of the rotary slide valve is advantageous.

The monitoring of the rotary slide valve with regard to improper functional states permits a rapid and targeted change of the operating state of the internal combustion engine in order to protect the latter. Furthermore, such monitoring permits a differentiated reaction, such that the emergency operation state only has to be implemented in actually critical situations.

The emergency operation state permits only restricted functioning of the internal combustion engine, and includes for example a limitation of a rotational speed and/or a torque of the internal combustion engine to a predetermined maximum emergency operation value. The limitation of rotational speed and/or torque to the maximum emergency operation value may be performed entirely electronically.

Depending on the detected fault of the rotary slide valve and the present cooling system state, the emergency operation state may be implemented only temporarily or else may be implemented permanently until the fault is eliminated.

It is normally the case that various monitoring and control systems are provided in the vehicle, which are partially separate and partially integrated. For example, components such as the rotary slide valve are in each case connected to an actuation unit, which outputs control commands and which preferably controls the execution thereof. The activation unit diagnoses any faults of the respective component and communicates these to superordinate systems.

The superordinate systems include for example a thermal management system, the correspondingly programmed electronics of which define the cooling system states of the cooling system in accordance with the prevailing requirements by way of suitable specification of the position of the rotary slide valve. The thermal management system advantageously receives feedback regarding actual states of, for example, coolant temperature sensors in individual coolant branches, the present position of the rotary slide valve, and messages regarding any improper states of the rotary slide valve. The thermal management system advantageously has access to control electronics of the internal combustion engine in order to be able to in particular reversibly restrict the rotational speed and/or the torque.

Furthermore, a separate emergency operation management system is preferably provided, which is responsible for triggering a reduction of the torque and/or the rotational speed, as a protective function in certain situations, by accessing the control electronics of the internal combustion engine. The emergency operation management system preferably communicates with the thermal management system and at least with the actuation unit of the rotary slide valve. The emergency operation management system generally effects a permanent and restrictive limitation of the operation of the internal combustion engine in order to reliably prevent damage.

A further superordinate system is for example a general monitoring system of the vehicle which, inter alia, monitors temperature sensors in the cooling system with regard to an exceedance of a setpoint temperature. The general monitoring system preferably communicates with the thermal management system.

The handling of the entire process, from the detection of an improper functional state, via the recording of the fault in a fault memory, the signaling of the fault and the appropriate reaction, to a possible re-enablement of the operating states of the internal combustion engine, may be performed by the thermal management system itself.

In certain cases, it is however expedient to follow a more restrictive approach and to transfer the handling of the fault to the emergency operation management system, which for example keeps the operating state of the internal combustion engine permanently in the emergency operation state until the fault memory is restored in a workshop, and the rotary slide valve is repaired or exchanged.

It is possible, for example upon the next vehicle restart, to check whether the rotary slide valve is again functioning properly. If so, the emergency operation state can be ended again, both by way of the thermal management system and by way of the emergency operation management system.

Depending on the design of the rotary slide valve, it is possible for multiple subcircuits of the cooling system to be simultaneously entirely or partially opened or closed.

Here, it is advantageously the case that, in a proper functional state, the controllable rotary slide valve provides feedback regarding the present switching position, even with regard to partially opened or partially closed inlets or outlets. The respective cooling system state can be identified from the present switching position of the rotary slide valve.

The improper functional state of the rotary slide valve may be defined for example by a movement stiffness of the rotary slide valve, a jamming of the rotary slide valve, a failure of an actuation unit of the rotary slide valve, or a failure of a position detector of the rotary slide valve.

The type of improper functional state, and the cooling system state defined by the present switching position of the rotary slide valve, are crucial for the reaction that is implemented.

One possible critical present switching position of the rotary slide valve corresponds, for example, to a state of the cooling system in which the vehicle cooler (radiator) is at least substantially not traversed by flow. In this case, at most a part of the maximum cooling power is available, and in the case of a high-power demand, that is to say in the case of high-torque and/or high rotational speed of the internal combustion engine, it would be possible for the coolant temperature in the internal combustion engine to rise to an excessively high value. In this case, the internal combustion engine is advantageously placed into the emergency operation state in order to prevent an excessive temperature increase. The initiation of the emergency operation state may possibly be made dependent on further parameters.

A present switching position of the rotary slide valve which corresponds to a state of the cooling system in which a flow through coolant lines in the internal combustion engine is at least partially throttled is to be regarded as being particularly critical. In this switching state, it is normally also the case that the vehicle cooler is not traversed by flow, such that the cooling power of the internal combustion engine is restricted almost or entirely to the minimum cooling power. Intense increases and power of the internal combustion engine could, in this state, lead to overheating. In this case, a rapid and highly restrictive switch to the emergency operation state is recommended.

It is preferably the case that a coolant temperature is detected, and that the operating state of the internal combustion engine is changed to the emergency operation state only above a threshold value temperature.

It is expedient for the coolant temperature to be detected in the region of a cylinder head of the internal combustion engine and/or for a coolant temperature in a coolant line immediately downstream of the internal combustion engine to be detected, that is to say at locations at which the maximum coolant temperature prevails.

If the coolant temperature still lies below the threshold value temperature, the thermal management system may decide that a restriction of the operating state of the internal combustion engine will not yet be performed.

In the above-described particularly critical cooling system states in which the cooler and possibly also the internal combustion engine are not traversed, or are only partially traversed, by a flow of coolant, it is however preferable for the emergency operation state to be immediately initiated regardless of the coolant temperature. This may also arise in the case of improper functional states, that is to say faults of the rotary slide valve which are highly probably permanent and which cannot be eliminated during ongoing driving operation or by way of a restart of the vehicle, for example in the event of the failure of a position detector or of control electronics. The initiation of the emergency operation state may, in such situations, be realized directly by way of the emergency operation manager which receives the respective fault message from the actuation unit of the rotary slide valve, in order to realize the most prompt possible reduction of the heat generation by the internal combustion engine.

In the case of an unthrottled or only partially throttled coolant flow through the vehicle cooler, the emergency operation state can be withdrawn again if the temperature falls below the threshold value temperature. In this case, it is in principle the case that adequate cooling power is available even for relatively high engine speeds and torques of the internal combustion engine. In this case, it may suffice for the coolant temperature to be monitored and for the operation of the internal combustion engine to be restricted only if the coolant temperature exceeds the predefined threshold value. This may be the case for example in the event of brief instances of demand for high power.

An initiation of the emergency operation state may be at least initially permitted if, in the present cooling system state, at least a minimum flow through the vehicle cooler is realized, even if the rotary slide valve is in an improper state, as long as the coolant temperature lies below the threshold value temperature. In the case of the vehicle cooler being partially or fully open, the cooling action is normally adequate for all operating states of the internal combustion engine, that is to say all rotational speed ranges, such that an intervention is necessary only if the coolant temperature rises to too great an extent.

In the case of the vehicle cooler being fully open, and thus in the case of a maximum coolant throughflow, it is possible here to wait for a possible fault message from the general monitoring system of the vehicle, and to implement the emergency operation state only when the general monitoring system responds.

In the case of a partial flow through the vehicle cooler, that is to say in cooling system states with a throttled coolant flow, however, the temperature monitoring is preferably performed by the thermal management system in order to shorten the reaction time before the start of the emergency operation state.

In the case of an improper functional state of the rotary slide valve which is defined by a failure of the position detector of the rotary slide valve, the rotary slide valve may be moved into a predetermined switching position in which the coolant lines in the internal combustion engine are traversed by a flow of coolant. Even if it is no longer possible to obtain reliable feedback regarding the present position of the rotary slide valve, it is possible in many cases for the rotary slide valve to be moved further into a known switching position in which, advantageously, an at least partial flow through the vehicle cooler and/or through the internal combustion engine is realized.

This may be realized for example by way of a movement of the rotary slide valve as far as an end stop. The arrival at the stop may be identified by way of an increased power consumption of the control motor that moves the rotary slide valve.

It is also possible for the rotary slide valve to be moved for a certain time period based on the assumption of the last known switching position, and then, if necessary, for the switching to be at least approximately determined through monitoring of the present coolant temperature.

Alternatively, the last known switching position may be assumed as a present switching position, and the rotary slide valve may be completely deactivated, that is to say locked. The setting of the operating state of the internal combustion engine is in this case performed in accordance with the last known switching position, and possibly the presently measured coolant temperatures. In this case, the emergency operation state is preferably initiated.

The improper functional state of the rotary slide valve referred to as "movement stiffness" is detected if the movement to a second predetermined position from a first predetermined switching position exceeds a setpoint time. As a reaction, a shaking-free step is preferably performed, in which the rotary slide valve is moved quickly between different switching positions multiple times in order to overcome the blockage. The shaking-free step may basically always be performed. Since it however takes a relatively long time, for example up to 20 seconds, it is preferable, in the presence of cooling system states with a throttled coolant flow through the internal combustion engine and possibly through the vehicle cooler and/or with an excessively high coolant temperature, for the emergency operation state to be initiated, that is to say for the rotational speed and/or torque of the internal combustion engine to be reduced, in order to be able to ensure adequate cooling power.

If the shaking-free step is successful, the operating state of the internal combustion engine can be re-enabled by the thermal management system. However, if the shaking-free step is not successful, the thermal management system preferably registers the fault state "jamming", and makes a decision regarding an enablement of the operating state or an initiation of the emergency operation state on the basis of the present switching position of the rotary slide valve and possibly the present coolant temperature.

In the improper functional states of the rotary slide valve and in the case of the emergency operation state of the internal combustion engine being implemented, a fault message is advantageously stored in a fault memory, and/or a fault display is triggered. The storage may be performed in a fault memory of the thermal management system, of the emergency operation management system and/or of the general monitoring system, where it can be read out by technical personnel during a workshop visit. Furthermore, it is possible for warning lamps and/or warning indicators on the dashboard to be activated in order to inform the driver. It is possible for different warning lamps and/or warning indicators to be provided for the emergency operation management system and for the thermal management system.

The method just described may be carried out for example by way of a protection system in a cooling system of an internal combustion engine, wherein the protection system includes a thermal management system, which receives and processes coolant temperatures, and an actuation unit of a switchable rotary slide valve with a position detector which can detect a present switching position of the switchable rotary slide valve, wherein the thermal management system is connected to the actuation unit of the rotary slide valve.

It is preferably the case that, in addition to the thermal management system, an emergency operation management system separate therefrom is provided, which communicates with the thermal management system. The emergency operation management system is preferably connected directly to the actuation unit of the rotary slide valve, and designed such that it can of its own accord, and independently of the thermal management system, trigger an initiation of the emergency operation state.

Other objects, advantages and novel features of the present invention will become apparent from the following detailed description of one or more preferred embodiments when considered in conjunction with the accompanying drawings.

DETAILED DESCRIPTION OF THE DRAWINGS

Figure 1:
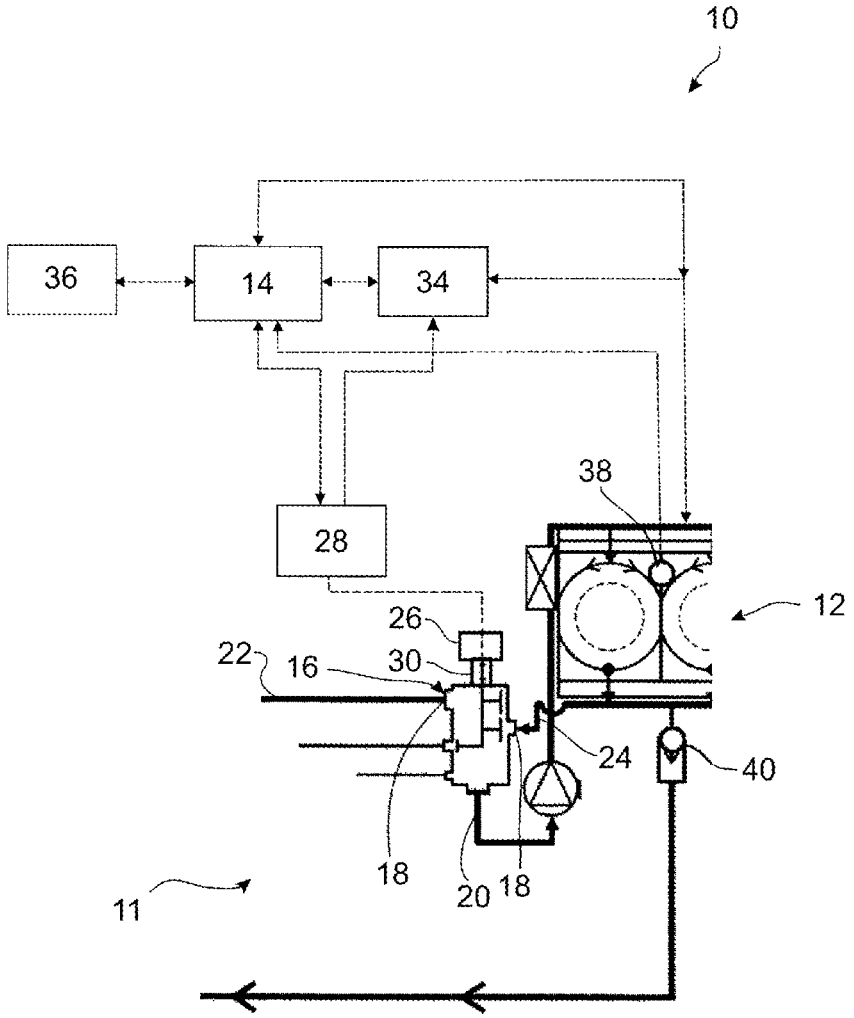
FIG. 1 is a schematic detail of a cooling system of an internal combustion engine having a protection system according to an embodiment of the invention for carrying out a method according to an embodiment of the invention.

FIG. 1 shows a protection system 10 in a cooling system 11 of an internal combustion engine 12, in this case in a passenger motor vehicle. The cooling system 11 is monitored and controlled by a thermal management system 14. The cooling system 11 is illustrated only as a detail, and in schematic form, in the figure, and shows only the elements essential to the invention in a detail of one of the cooling circuits of said cooling system. The cooling system 11 may be of arbitrarily complex design, and may have additional subcircuits, which may be interconnected at the discretion of a person skilled in the art.

The coolant flow in the cooling circuits is controlled substantially by way of a controllable rotary slide valve 16 which has at least one switched inlet 18 or one switched outlet 20. In the example illustrated here, all of the inlets 18 with the exception of one are switchable, and the outlet 20 is not switched. It would however also be possible for a suitable rotary slide valve of some other design to be used.

The different switching position of the rotary slide valve 16 define different states of the cooling system 11.

In a first cooling system state, the rotary slide valve 16 is switched such that a vehicle cooler (not illustrated) and coolant lines in the internal combustion engine 12 are traversed by a maximum coolant flow or by an only slightly throttled coolant flow. The inlet 18, which is connected to the cooler return line 22, of the rotary slide valve 16 is at least partially open, such that the so-called large cooling circuit is traversed by flow, in which the coolant flows through the vehicle cooler and through the internal combustion engine 12, in particular the cylinder head. A bypass line 24 from the internal combustion engine 12 to a second switched inlet 18 of the rotary slide valve 16 is, in this case, closed.

In said first state, with the cooler return line 22 fully open, the maximum cooling power of the cooling system 11 is available to the internal combustion engine 12.

In a second state of the cooling system 11, the inlet 18, which is connected to the cooler return line 22, is partially open, as is the inlet 18', which is connected to the bypass line 24, resulting in a partially reduced cooling power.

In a third cooling system state, the vehicle cooler is fully throttled, such that it is no longer traversed by flow. For this purpose, the inlet 18, which is connected to the cooler return line 22, of the rotary slide valve 16 is closed. The inlet 18', which is connected to the bypass line 24, is, by contrast, fully open, such that the full flow cross section of the bypass line 24 is traversed by flow. In this case, the so-called small cooling circuit through the internal combustion engine 12, but not through the vehicle cooler, is traversed by a flow of coolant. The cooling power is further reduced in relation to the second cooling system state.

In a fourth possible cooling system state, the inlet 18 connected to the cooler return line 22 is fully closed, whereas the inlet 18', which is connected to the bypass line 24, of the rotary slide valve 16 is partially open, such that a part of the flow cross section of the bypass line 24 is closed. The cooling power is therefore further reduced in relation to the third cooling system state.

In a fifth cooling system state, both the inlet connected to the cooler return line 22 and that connected to the bypass line 24 are fully closed, such that neither the vehicle cooler nor the cylinder head are traversed by a flow of coolant. In this case, the cooling system 11 provides only the minimum cooling power.

The individual cooling system states may transition into one another in continuous fashion. Further cooling states are self-evidently likewise possible, in which for example further subcircuits (not described here) of the cooling system 11 are activated or deactivated.

The rotary slide valve 16 is equipped with a position detector which detects the present switching position of the rotary slide valve 16 and which is connected to an actuation unit 28 which actuates an electric control motor 30 which moves the rotary slide valve 16 into the respectably desired switching position. The actuation unit 28 communicates with the thermal management system 14, and the thermal management system 14 predefines a setpoint state for the switching positions of the rotary slide valve 16 in accordance with the respective requirements.

In this example, the thermal management system 14 has access to control electronics (not illustrated) of the internal combustion engine 12, and can, in the event of faults, restrict torque and rotational speed to an emergency operation state, for example a fixedly predefined low torque, in order to reduce the heat generated by the internal combustion engine 12.

Furthermore, in the embodiment described, the actuation unit 28 of the rotary slide valve 16 communicates with an emergency operation management system 34. The emergency operation management system 34 serves for the direct protection of the internal combustion engine 12 against overloading, and for this purpose, likewise has access to the control electronics of the internal combustion engine 12, and in the event of faults can restrict torque and rotational speed to an emergency operation state. In this example, the emergency operation management system 34 also communicates with the thermal management system 14.

Furthermore, in the example shown here, a general monitoring system 36 is provided which, for example, performs general fault management of the vehicle. Inter alia, the general monitoring system 36 in this case monitors coolant temperatures at various locations in the cooling system 11.

Here, multiple temperature sensors 38, 40 are provided in the cooling system 11, which temperature sensors detect a coolant temperature, wherein one temperature sensor 38 is arranged directly in the cylinder head, and one temperature sensor 40 is positioned downstream of the cylinder head in the feed line to the vehicle cooler. It is also possible for further temperature sensors to be provided. The temperature sensors 38, 40 are in this case connected to the thermal management system 14, such that the present coolant temperatures are available to the latter at all times.

The thermal management system 14, the actuation unit 28 of the rotary slide valve 16 including the position detector 26, the temperature sensors 38, 40, the emergency operation management system 34 and the general monitoring system 36 are in this case part of the protection system 10.

The above-described cooling system states are, in the case of default-free functioning, in proper functional states of the rotary slide valve 16, assumed by virtue of the actuation unit 28 moving the rotary slide valve 16 in accordance with the commands from the thermal management system 14. However, if the rotary slide valve 16 is operating in a faulty manner, improper functional states may arise. These are detected by the thermal management system 14 and/or by the emergency operation management system 34, and are evaluated with regard to their influence on the behavior of the cooling system 11, whereupon corresponding measures adapted to the fault state are implemented.

A first improper functional state of the rotary slide valve 16 arises for example if the latter functions with movement stiffness. In this example, movement stiffness is detected through monitoring of the time taken for the rotary slide valve 16 to pass from one switching position into another switching position. If the time actually required exceeds a predefined value, the fault state "movement stiffness" is identified.

In this case, the actuation unit 28 triggers the implementation of a shaking-free routine, in which the rotary slide valve 16 is for example moved as rapidly and abruptly as possible between different predefined positions in both directions of rotation multiple times in order to release the rotary slide of the valve again. This shaking-free routine may possibly be performed multiple times, wherein the execution and evaluation are controlled for example by programs stored in the actuation unit 28.

If the shaking-free routine is successful, it is thereafter possible for the thermal management system 14 to operate the cooling system 11 normally again.

However, if the shaking-free routine is not successful, a second improper functional state "jamming" is identified, in which it is assumed that the rotary slide valve 16 can no longer be moved correctly, and in the extreme case, remains permanently in the present switching position.

A third possible improper functional state relates to the failure of a position sensor or of another part of the position detector 26. In this case, the rotary slide valve 16 can duly still be actuated and moved, but feedback regarding the present switching position is no longer available.

In this example, not only a position sensor but also further means for detecting at least the end positions of the rotary slide of the rotary slide valve 16 are provided in the position detector 26. For example, a power consumption of the control motor 30 that adjusts the rotary slide is monitored in order to conclude, from an increase in power consumption, that an end stop has been reached. Furthermore, the time for which the control motor 30 is in operation is predefined.

A fourth improper functional state arises if other faults in the electronics or in the actuator arise which no longer permit normal operation of the rotary slide valve 16. This may for example involve an electrical failure or an electronics fault, and likewise includes a failure of the control motor 30.

In this example, any detected improper functional state of the rotary slide valve 16 is stored in a fault memory. In this example, permanent faults ("jamming", a failure of the position detector 26 or other faults in the electronics or in the actuator) is displayed in the cockpit by way of one or more warning lamps and/or warning indicators.

Depending on the improper functional state of the rotary slide valve that has occurred and depending on the present cooling system state, different measures are implemented. A possible decision diagram in the event of the occurrence of the described improper functional states is illustrated in FIG. 2.

Figure 2:
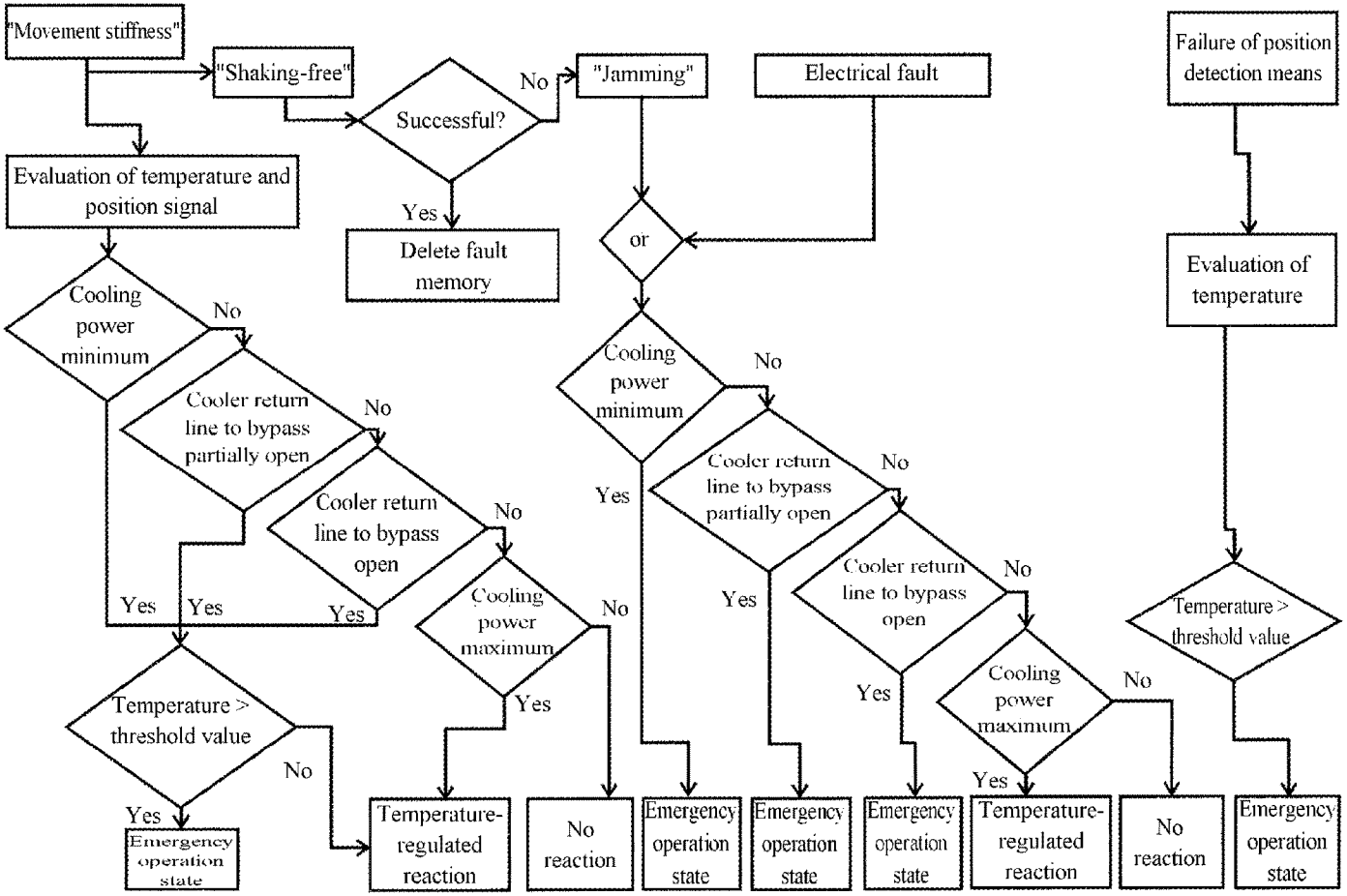
FIG. 2 is a flow diagram of an exemplary method according to the invention.

Referring to FIG. 2, in the event of a movement stiffness being detected (first improper functional state), it is basically the case in this example that a shaking-free routine is implemented.

Depending on the cooling system state, this may be preceded by a waiting period. In this case, this is performed if the vehicle cooler is fully traversed by flow or is only partially traversed by flow in a throttled manner, because the provided cooling power is, in principle, adequate for all operating states of the internal combustion engine.

If the vehicle cooler is traversed by flow in a throttled manner, the coolant temperature detected by way of the sensors 38, 40 is incorporated. If said coolant temperature lies above a predefined threshold value temperature, the internal combustion engine 12 is placed into an emergency operation state.

In the emergency operation state, in the embodiment described here, the rotational speed and/or the torque of the internal combustion engine 12 are restricted to a predefined emergency operation value, which is dependent on the vehicle and at which the internal combustion engine 12 can be reliably operated even with a reduced coolant throughflow.

The initiation of the emergency operation state, and the monitoring and possibly the ending thereof, may in this case be performed both by the thermal management system 14 and by the emergency operation management system 34 of the vehicle, possibly in cooperation with the general monitoring system 36.

If movement stiffness of the rotary slide valve 16 is identified and the cooling system is in the first or second state, the internal combustion engine 12 is placed into the emergency operation state by the thermal management system 14 only if the threshold value temperature is exceeded. The thermal management system 14 re-enables the operation of the internal combustion engine 12 over the entire power range when the coolant threshold value temperature is undershot again, or if the shaking-free routine is successful.

If the rotary slide valve 16 is detected as exhibiting movement stiffness in a cooling system state in which the maximum cooling power is provided, it is also possible, initially without intervention by the thermal management system 14, to await a temperature-controlled reaction of the general monitoring system 36 before the emergency operation state is initiated.

However, if movement stiffness is identified when the cooling system 11 is in a state in which a flow through the vehicle cooler is prevented (third to fifth cooling system state), then in a manner dependent on the present coolant temperature, the emergency operation state is triggered in the event of an exceedance of the coolant threshold value temperature. Depending on the temperature, this is maintained for the duration of the shaking-free routine, because in these cooling system states, the cooling system 11 reacts sensitively to intense changes in power of the internal combustion engine 12, and during the shaking-free routine, it is not ensured that adequate cooling power can be provided.

If the shaking-free routine is successful, then in this example the thermal management system 14 transmits an enable signal to the controller of the internal combustion engine, which re-enables all operating states of the internal combustion engine 12.

However, if the shaking-free routine is not successful, the state "jamming" (second improper functional state) is identified.

If the cooling system as in the first state in which the maximum cooling power is available, that is to say the rotary slide valve 16 is jammed in the position in which the inlet 18 that is connected to the cooler return line 22 is fully open, then in this example, the coolant temperature is monitored by the thermal management system 14 and/or by the general monitoring system 36, and the emergency operation state is initiated only in the event of an exceedance of the coolant temperature threshold. The thermal management system 14 withdraws the emergency operation state again in the event of the coolant temperature threshold being undershot again.

If the vehicle cooler is partially throttled (second cooling system state), the coolant temperature is monitored by the thermal management system 14, and the emergency operation state is temporarily initiated in the event of an exceedance of the coolant threshold value temperature.

However, if jamming is detected when the cooling system is in a state in which the flow through the vehicle cooler is prevented (third to fifth cooling system state), the fault is handled by the emergency operation management system 34, which in this example places the internal combustion engine 12 permanently into the emergency operation state regardless of the coolant temperature. The emergency operation state may be maintained permanently until the fault is withdrawn, or until a restart of the vehicle.

It is possible, after a restart of the vehicle, for the function of the rotary slide valve 16 to be checked again, and for the emergency operation state to be withdrawn again in the event of proper functioning. Otherwise, the operating state of the internal combustion engine 12 is re-enabled only after the fault has been eliminated in a workshop, and the fault memory has been reset.

In the event of a failure of the position detector 26, in particular in the event of failure of a position sensor which provides feedback regarding the present switching position of the rotary slide valve 16 (third improper functional state), the thermal management system 14 monitors the present coolant temperature and initiates the emergency operation state in the event of an exceedance of the threshold value temperature. If multiple improper functional states arise simultaneously, a failure of the position detector 26 is assigned the highest priority.

In this case, the emergency operation state may be handled either by the thermal management system 14 or by the emergency operation management system 34.

Furthermore, the rotary slide valve 16 is moved into a switching position in which the greatest possible cooling power is available. This is achieved for example by virtue of the rotary slide valve 16 being moved in the presently set rotational direction as far as a stop, wherein the rotary slide valve 16 is self-evidently designed such that the stop coincides with a switching position which yields adequate cooling power (cooler return line 22 fully or partially open). It may either be assumed in a time-controlled manner that the stop has been reached, or it may be detected that the stop has been reached through monitoring of the power consumption of the control motor 30.

After the predefined position has been reached, the rotary slide valve 16 is deactivated. If the rotary slide valve 16 can be moved into a switching position in which the maximum cooling power, or an only slightly reduced cooling power, is available, the initiation of the emergency operation state may be made dependent on the exceedance of the threshold value temperature.

If another fault arises in the electronics or in the actuator of the rotary slide valve 16 (fourth improper functional state), then in this example, with maximum cooling power (first cooling system state), it is merely the case that a fault is output, and possibly a warning lamp and/or a warning indicator is activated, but otherwise the thermal management system 14 and/or the general monitoring system 36 performs the monitoring of the coolant temperature.

In the case of reduced cooling power (in the second cooling system state, in which the cooler return line 22 is only partially open), the fault is handled by the thermal management system 14. Here, said thermal management system initiates the emergency operation state in a temperature-dependent manner. The emergency operation state may be maintained permanently until the withdrawal of the fault, or until a restart of the vehicle.

In all other cooling system states, in which the cooler return line 22 is closed, in this example, the emergency operation state is initiated and the control of the emergency operation state is performed by the emergency operation management system 34. The driver is notified of this state in this case by way of a further warning lamp and a prompt to have the fault repaired.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A method for operating a cooling system of an internal combustion engine, in which a controllable rotary slide valve having at least one switched inlet or outlet is provided, the method comprising the acts of:

monitoring movement of the rotary slide valve into multiple switching positions which correspond to, in each case, one cooling system state, and in a manner dependent on an improper functional state of the rotary slide valve and a present switching position of the rotary slide valve, changing an operating state of the internal combustion engine to an emergency operation state in which a rotational speed and/or a torque of the internal combustion engine is limited to a predetermined maximum emergency operation value.

2. The method according to claim 1, wherein the improper functional state of the rotary slide valve is defined by a movement stiffness of the rotary slide valve, a jamming of the rotary slide valve, a failure of an actuation unit of the rotary slide valve or a failure of a position detector of the rotary slide valve.

3. The method according to claim 2, wherein the present switching position of the rotary slide valve corresponds to a state of the cooling system in which a vehicle cooler is at least substantially not traversed by flow.

4. The method according to claim 3, wherein the present switching position of the rotary slide valve corresponds to a state of the cooling system in which a flow through coolant lines in the internal combustion engine is at least partially throttled.

5. The method according to claim 2, wherein in the case of an improper functional state of the rotary slide valve which is defined by a failure of the position detector of the rotary slide valve, the rotary slide valve is moved into a predetermined switching position in which coolant lines in the internal combustion engine are traversed by a flow of coolant.

6. The method according to claim 1, wherein the present switching position of the rotary slide valve corresponds to a state of the cooling system in which a vehicle cooler is at least substantially not traversed by flow.

7. The method according to claim 6, wherein the present switching position of the rotary slide valve corresponds to a state of the cooling system in which a flow through coolant lines in the internal combustion engine is at least partially throttled.

8. The method according to claim 1, wherein a coolant temperature is detected, and the operating state of the internal combustion engine is changed to the emergency operation state only above a threshold value temperature of the coolant temperature.

9. The method according to claim 8, wherein the emergency operation state limits one or more of a rotational speed or a torque of the internal combustion engine to a predetermined emergency operation value.

10. The method according to claim 8, wherein in the case of an unthrottled or only partially throttled coolant flow through a vehicle cooler, the emergency operation state is withdrawn again if the coolant temperature falls below the threshold value temperature.

11. The method according to claim 10, wherein the emergency operation state is not implemented if, in the present cooling system state, at least a minimum flow through the vehicle cooler is realized, even if the rotary slide valve is in an improper state, as long as the coolant temperature lies below the threshold value temperature.

12. The method according to claim 8, wherein the emergency operation state is not implemented if, in the present cooling system state, at least a minimum flow through a vehicle cooler is realized, even if the rotary slide valve is in an improper state, as long as the coolant temperature lies below the threshold value temperature.

13. The method according to claim 1, wherein in a functional state of the rotary slide valve in which a movement to a second predetermined switching position from a first predetermined switching position exceeds a setpoint time, a shaking-free step is performed, in which the rotary slide valve is moved quickly between different switching positions multiple times.

14. The method according to claim 1, wherein in the improper functional states of the rotary slide valve and in the case of the emergency operation state of the internal combustion engine being implemented, a fault message is stored in a fault memory and/or a fault display is triggered.

15. A protection system in a cooling system of an internal combustion engine, comprising:

a thermal management system that receives and processes coolant temperatures;

an actuation unit for a controllable rotary slide valve having at least one switched inlet or outlet;

a position detector that detects a present switching position of the controllable rotary slide valve, wherein the thermal management system is connected to the actuation unit of the controllable rotary slide valve, the protection system being configured to:

monitor movement of the rotary slide valve into multiple switching positions which correspond to, in each case, one cooling system state, and in a manner dependent on an improper functional state of the rotary slide valve and a present switching position of the rotary slide valve, change an operating state of the internal combustion engine to an emergency operation state in which a rotational speed and/or a torque of the internal combustion engine is limited to a predetermined maximum emergency operation value.

16. The protection system according to claim 15, wherein the improper functional state of the rotary slide valve is defined by a movement stiffness of the rotary slide valve, a jamming of the rotary slide valve, a failure of an actuation unit of the rotary slide valve or a failure of a position detector of the rotary slide valve.

17. The protection system according to claim 16, wherein the present switching position of the rotary slide valve corresponds to a state of the cooling system in which a vehicle cooler is at least substantially not traversed by flow.

18. The protection system according to claim 15, wherein the present switching position of the rotary slide valve corresponds to a state of the cooling system in which a flow through coolant lines in the internal combustion engine is at least partially throttled.

* * * * *